US010731392B2

(12) United States Patent
Salice

(10) Patent No.: US 10,731,392 B2
(45) Date of Patent: Aug. 4, 2020

(54) LIFTING SYSTEM FOR DOOR LEAVES OF FURNITURE THAT SWING ABOUT AT LEAST ONE HORIZONTAL AXIS

(71) Applicant: ARTURO SALICE S.P.A., Novedrate (IT)

(72) Inventor: Luciano Salice, Carimate (IT)

(73) Assignee: ARTURO SALICE S.P.A., Novedrate (IT)

( * ) Notice: Subject to any disclaimer, the term of this patent is extended or adjusted under 35 U.S.C. 154(b) by 0 days.

(21) Appl. No.: 16/323,960

(22) PCT Filed: Aug. 4, 2017

(86) PCT No.: PCT/EP2017/069806
§ 371 (c)(1),
(2) Date: Feb. 7, 2019

(87) PCT Pub. No.: WO2018/029105
PCT Pub. Date: Feb. 15, 2018

(65) Prior Publication Data

US 2019/0178016 A1 Jun. 13, 2019

(30) Foreign Application Priority Data

Aug. 8, 2016 (IT) ..... 102016000083263

(51) Int. Cl.
*E05F 1/08* (2006.01)
*E05F 1/10* (2006.01)
(Continued)

(52) U.S. Cl.
CPC ..... *E05F 1/105* (2013.01); *E05D 15/40* (2013.01); *E05D 3/142* (2013.01);
(Continued)

(58) Field of Classification Search
CPC . Y10T 16/554; Y10T 16/551; Y10T 16/5385; Y10T 16/5383; Y10T 16/547;
(Continued)

(56) References Cited

U.S. PATENT DOCUMENTS 4,236,272 A * 12/1980 Gronbach ..... E05D 11/1021 16/288
4,837,894 A * 6/1989 Lin ..... E05D 3/16 16/288
(Continued)

FOREIGN PATENT DOCUMENTS

DE 202006000535 U1 3/2006
EP 1148200 A2 10/2001
(Continued)

OTHER PUBLICATIONS

International Search Report and Written Opinion dated Oct. 18, 2017 issued in PCT/EP2017/069806.
(Continued)

*Primary Examiner* — Chuck Y Mah
(74) *Attorney, Agent, or Firm* — Scully, Scott, Murphy & Presser, P.C.

(57) ABSTRACT

A lifting system for door leaves of furniture that swing about at least one horizontal axis between a closed position and a raised open position, the lifting system comprising a supporting body which can be connected to a fixed portion of the item of furniture, a system of articulated levers which are connected to the supporting body and to a door leaf of the item of furniture, the system of levers comprising a first lever which has an end connected rotatably to the supporting body and a second lever, the first lever and the second lever being mutually articulated at the respective other ends, and elastic actuation means, which are functionally connected to the system of articulated levers in order to generate a
(Continued)

rotation torque for the system of levers, and further comprising elastic initial opening means.

6 Claims, 4 Drawing Sheets

(51) Int. Cl.
*E05D 15/40* (2006.01)
*E05D 3/14* (2006.01)

(52) U.S. Cl.
CPC ..... *E05Y 2201/22* (2013.01); *E05Y 2201/244* (2013.01); *E05Y 2201/41* (2013.01); *E05Y 2201/426* (2013.01); *E05Y 2201/474* (2013.01); *E05Y 2201/624* (2013.01); *E05Y 2800/22* (2013.01); *E05Y 2900/20* (2013.01)

(58) Field of Classification Search
CPC ..... Y10T 16/53864; E05D 7/04; E05D 7/06; E05D 7/0407; E05D 7/0415; E05D 3/186; E05D 3/06; E05D 3/122; E05D 3/14; E05D 3/142; E05D 3/16; E05D 2003/163; E05D 11/06; E05D 5/0276; E05D 15/40; E05Y 2201/426; E05Y 2201/414; E05Y 2201/618; E05Y 2201/62; E05Y 2201/624; E05Y 2201/71; E05Y 2201/716; E05Y 2201/712; E05Y 2900/20; E05Y 2800/22; E05F 3/20; E05F 5/006; E05F 1/105
See application file for complete search history.

(56) References Cited

U.S. PATENT DOCUMENTS 4,843,680 A * 7/1989 Cress ..... E05F 1/1276 16/289
7,500,287 B2 * 3/2009 Brustle ..... E05F 1/1075 16/286
7,810,213 B2 * 10/2010 Brustle ..... E05F 1/1075 16/286
7,987,558 B2 * 8/2011 Beckmann ..... E05D 11/0054 16/366
8,205,298 B2 * 6/2012 Lin ..... E05F 5/006 16/245
8,225,459 B2 * 7/2012 Waltemate ..... E05F 1/1261 16/366
8,572,811 B2 * 11/2013 Lautenschlager ..... E05D 3/14 16/370
8,713,760 B2 * 5/2014 Krudener ..... E05D 3/16 16/370
9,169,681 B2 * 10/2015 Cooper ..... E05D 3/183
9,277,817 B2 * 3/2016 Blum ..... E05F 1/1276
9,528,307 B2 * 12/2016 Rohner ..... E05D 3/16
9,739,081 B2 * 8/2017 Stuke ..... E05F 5/10
2006/0090296 A1 * 5/2006 Zetti ..... E05D 3/16 16/302
2008/0276425 A1 * 11/2008 Gherardi ..... A47L 15/4261 16/319
2017/0241176 A1 * 8/2017 Zetti ..... E05D 11/06
2018/0087307 A1 * 3/2018 Hammerer ..... E05F 3/20

FOREIGN PATENT DOCUMENTS

EP 2321486 A1 5/2011
WO WO 2010/022414 A1 3/2010
WO WO 2011/020130 A1 2/2011

OTHER PUBLICATIONS

Italian Search Report dated May 19, 2017 issued in IT 201600083263, with partial translation.

* cited by examiner

LIFTING SYSTEM FOR DOOR LEAVES OF FURNITURE THAT SWING ABOUT AT LEAST ONE HORIZONTAL AXIS

BACKGROUND

The present invention relates to a lifting system for door leaves of furniture that swing about at least one horizontal axis.

In the furniture sector, the use is known of furniture that has door leaves that can be opened upward by way of a swinging movement about at least one horizontal axis. Such door leaves are in particular connected to a fixed body of the item of furniture by way of hinges that are contoured to enable the door leaves to perform this swinging movement.

In order to lift the door leaf, there are adapted lifting systems, which conventionally comprise a supporting body that can be connected to the fixed portion of the item of furniture, a system of articulated levers that connects the supporting body with the fixing element, which can be connected to the door leaf, and elastic actuation means that are functionally connected to a lever of the system of levers in order to give rise to a rotation torque such as to push the door leaf toward a raised open position.

For tilting door leaves that open upward, which do not have handles, there is a fastening device for retaining the door leaf in the closed position, and this device can be disengaged by the user pressing on the closed door leaf. Once the door leaf is disengaged, in order to enable the user to grip it in order to complete the opening operation, there is generally an elastic means for imparting an initial opening movement on the door leaf. Such a solution is for example described in DE 202006000535U and in EP2321486.

SUMMARY

The aim of the present invention is to provide a lifting system for door leaves of furniture that swing about at least one horizontal axis, with an elastic "initial opening" system, so that the user can open the tilting door leaf with ease.

Within this aim, an object of the present invention is to provide a lifting system for door leaves of furniture that swing about at least one horizontal axis, with door leaves without a handle, in which the elastic initial opening system is simple in construction and offers optimized operation.

Another object of the present invention is to provide a lifting system for door leaves of furniture that swing about at least one horizontal axis, in which the preloading of the elastic "initial opening" system is adjustable.

Another object of the present invention is to provide a lifting system for door leaves of furniture that swing about at least one horizontal axis which is highly reliable, easily and practically implemented and low cost.

This aim and these and other objects which will become better apparent hereinafter are achieved by a lifting system for door leaves of furniture that swing about at least one horizontal axis between a closed position and a raised open position, the lifting system comprising a supporting body which can be connected to a fixed portion of the item of furniture, a system of articulated levers which are connected to said supporting body and to a door leaf of the item of furniture, said system of levers comprising a first lever which has an end connected rotatably to said supporting body by way of a rotation axis and a second lever which has an end that can be connected rotatably to an element for fixing on said door leaf of the item of furniture, said first lever and said second lever being mutually articulated at the respective other ends, and elastic actuation means, which are functionally connected to said system of articulated levers in order to generate a rotation torque for said system of levers, characterized in that it comprises elastic initial opening means which are adapted to act functionally on said second lever of said system of articulated levers.

BRIEF DESCRIPTION OF THE INVENTION

Further characteristics and advantages of the invention will become better apparent from the description of a preferred, but not exclusive, embodiment of the lifting system according to the present invention, which is illustrated by way of non-limiting example in the accompanying drawings wherein.

DETAILED DESCRIPTION OF THE INVENTION

Figure 1:
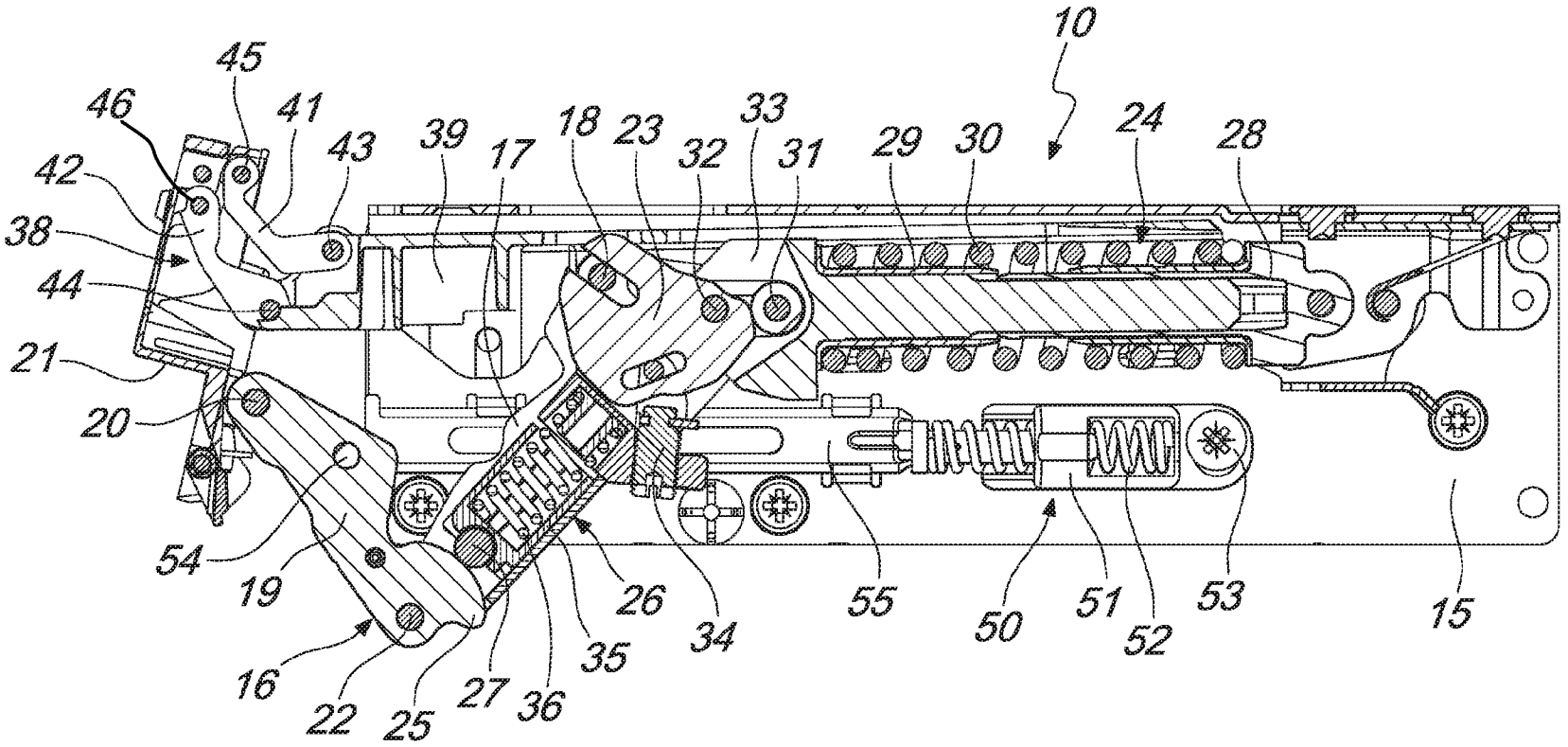
FIG. 1 is a cross-sectional view of the lifting system for door leaves of furniture that swing about at least one horizontal axis according to the invention, in the condition in which the door leaf is partially open.
Figure 2:
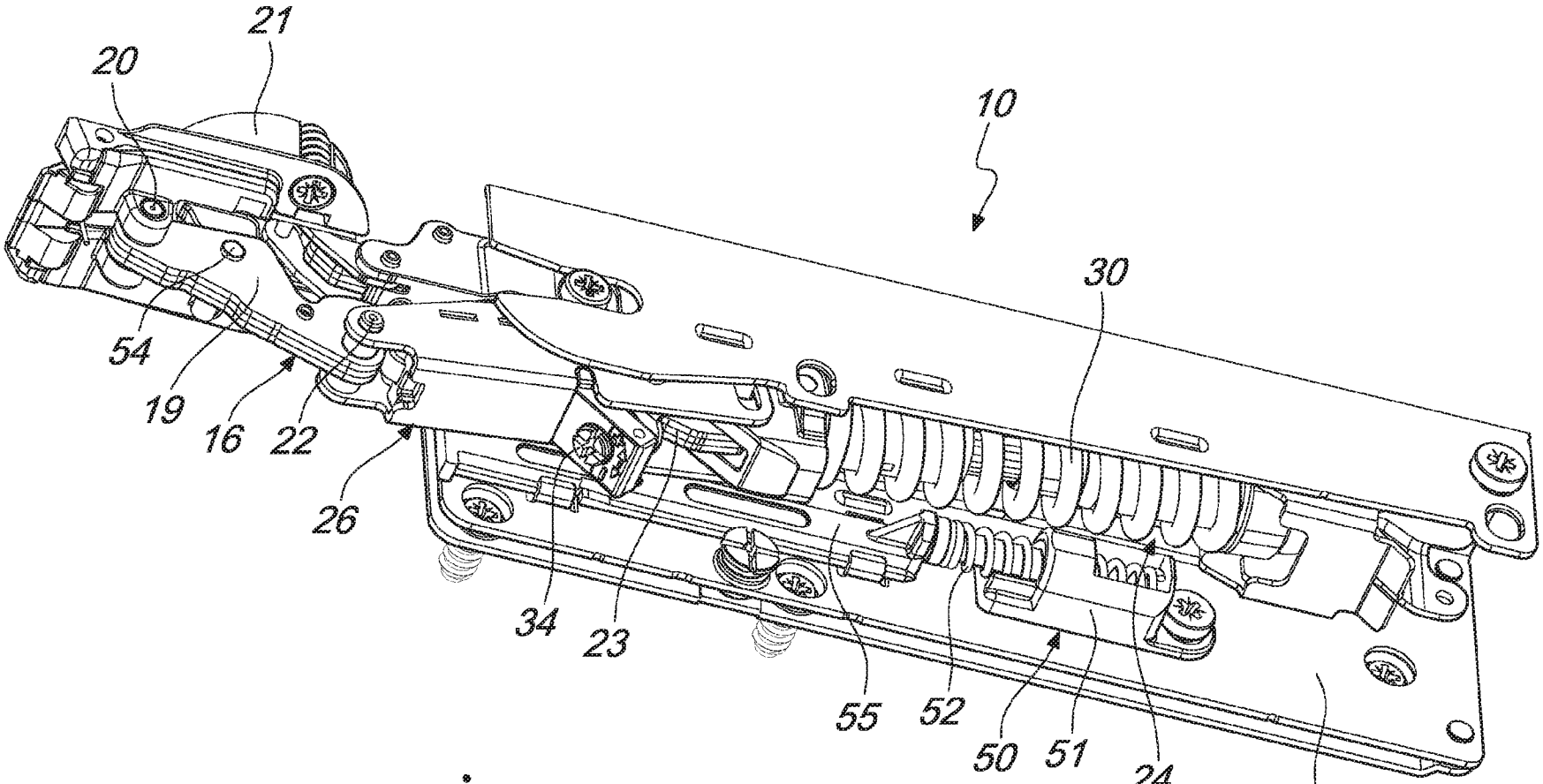
FIG. 2 is a perspective view from below of the lifting system of FIG. 1, in the condition in which the door leaf is open.
Figure 3:
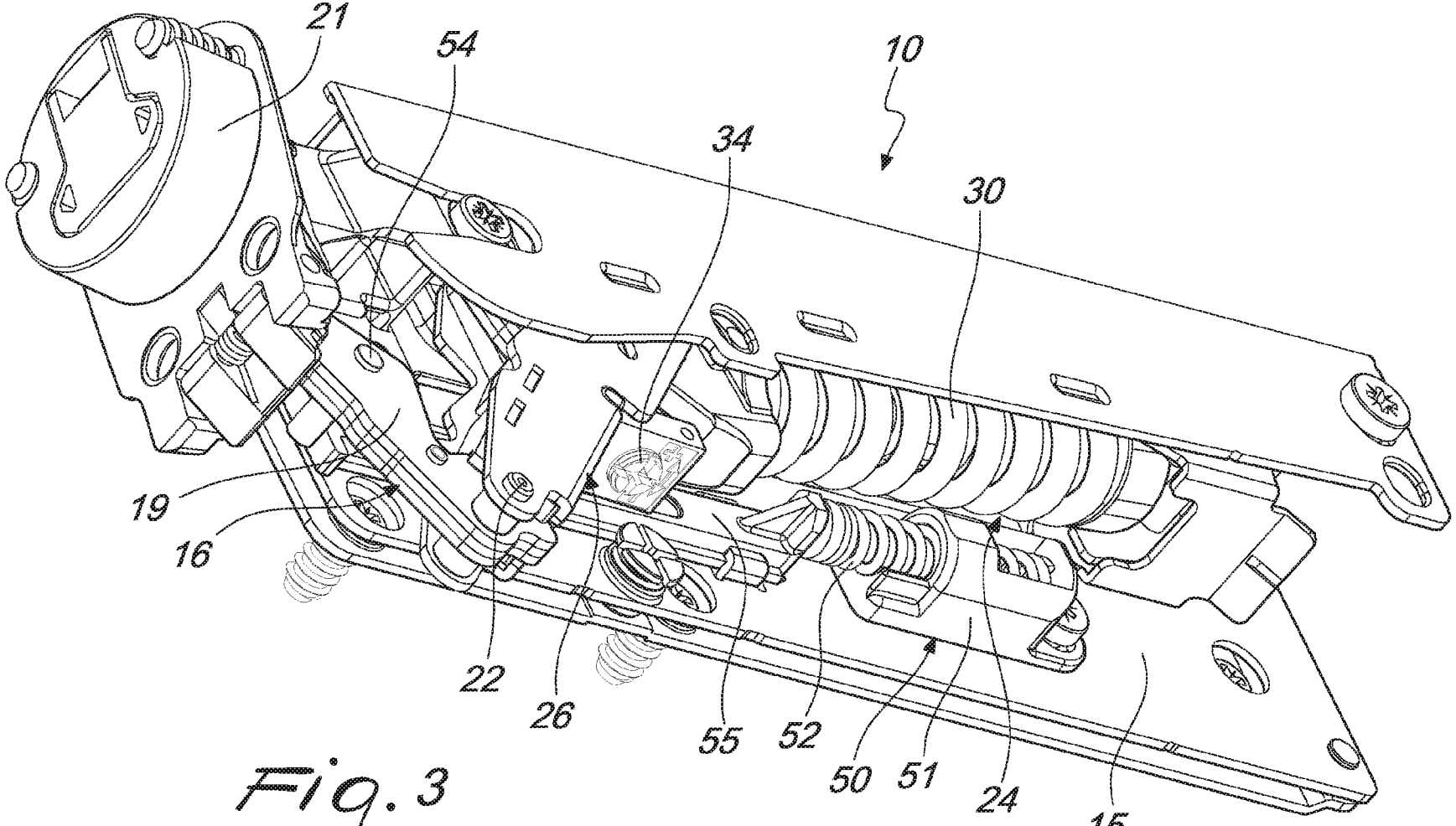
FIG. 3 is another perspective view from below of the lifting system according to the invention, in the condition corresponding to that of FIG. 1.
Figure 4:
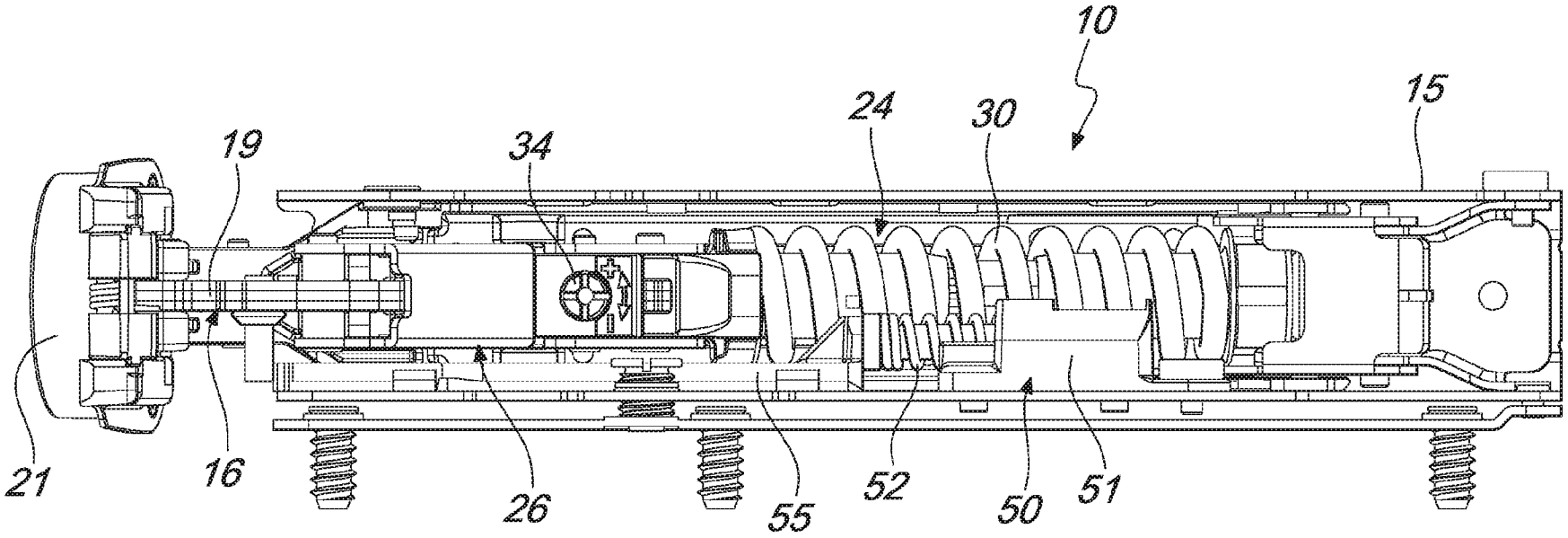
FIG. 4 is a plan view from below of the lifting system according to the invention.

With reference to the figures, the lifting system according to the invention, generally designated by the reference numeral 10, comprises a supporting body 15 that can be connected to a fixed portion of an item of furniture, not shown, and which comprises a system of articulated levers 16 that connect the supporting body 15 to a door leaf of an item of furniture (also not shown) and elastic actuation means that are functionally connected to the system of articulated levers 16 and which generate a rotation torque on that system of levers.

The system of levers 16 in turn comprises a first lever 17 which has an end connected rotatably to the supporting body 15 by way of a first rotation axis 18 and a second lever 19 which has an end that can be connected rotatably about a second rotation axis 20 to a fixing element 21 that can be applied to the door leaf of the piece of furniture.

The first lever 17 and the second lever 19 are further mutually articulated at the respective other ends by way of an intermediate rotation axis 22.

In order to create a rotation torque at least in the direction of opening for the system of levers 16, in general it is possible to connect elastic means between the supporting body 15 and a point of the first lever 17 that is located at a certain distance from the rotation axis 18 of the lever 17, so as to define a lever arm for the force of the elastic means which is such as to generate the aforementioned torque.

The oscillation of the lever 17 creates an increasing lever arm that adjusts the torque exerted by the elastic means to the opposite torque created by the weight of the door leaf in its opening movement.

According to the invention, the lifting system 10 comprises cam means on at least one of the levers 17 and 19 of the system of articulated levers 16, and such cam means are shaped and arranged in order to suitably interact with the elastic actuation means in order to generate a further quantity of torque that, along at least one portion of oscillation of the door leaf in the lifted position of that door leaf 13, is added to the rotation torque of the system of levers that would be generated by the elastic means in the absence of such conveniently configured cam means.

The cam means comprise a first cam element 23 connected to the first lever 17 of the system of articulated levers 16, and the first element 23 interacts with first axially deformable elastic stress means 24 which are arranged between the supporting body 15 and the first lever 17 and are functionally connected to the first cam element 23.

The position of the first cam element 23 is preferably adjustable, for example by way of an adjustment screw 34.

The cam means conveniently comprise a second cam element 25 which is part of either the first lever 17 or the second lever 19 of the system of articulated levers 16, for example part of the lever 19 at the intermediate rotation axis 22; the second cam element 25 interacts with second axially deformable elastic means 26 which are arranged on the other one of either the first lever 17 or the second lever 19 of the system of articulated levers 16, for example on the first lever 17, and is functionally connected by way of a sliding or rolling means 27 which is supported so that it can slide by the lever 17 provided with the second elastic means 26.

The first elastic means 24 comprise a first portion 28 which is connected rotatably to the supporting body 15 and a second portion 29 which is connected to the first portion 28 so that it can slide along a longitudinal axis. In turn, the second portion 29 is connected to the first lever 17 of the system of articulated levers 16 so that it can slide at a point of the first lever 17 which is spaced apart from the rotation axis 18 of that lever 17.

At least one axially deformable elastic element, preferably in the form of a helical spring 30, is interposed between the first portion 28 and the second portion 29.

There is furthermore a sliding or rolling means, preferably in the form of a roller 31, which is connected to the second portion 29, which is shaped and arranged so as to act on the first cam element 23.

Preferably, the rotatable and slideable connection between the second portion 29 of the first elastic means 24 and the first lever 17 of the system of levers 16 is obtained by way of a pivot 32, which is integral with the first lever 17, and more preferably the first cam element 23 is arranged at the aforementioned point of the lever 17 which is spaced apart from the rotation axis 18. The pivot 32 is engaged so that it can slide and rotate in a fork 33 defined at the end of the second portion 29, which is directed toward the first lever 17.

The second cam element 25 interacts with the second axially deformable elastic means 26 which are arranged on the other lever of the system of articulated levers, for example on the lever 17, by way of a sliding or rolling means, for example a roller 27 supported so that it can slide by the lever 17 provided with the second elastic means 26.

Preferably, the second elastic means 26 comprise a first portion and a second portion 35 for accommodating the elastic means which are preferably in the form of a helical spring 36.

In order to support the door leaf of the piece of furniture so that it can oscillate, each lifting system 10 preferably comprises a hinge 38, which in turn preferably comprises a fixed portion 39 that can be connected to the supporting body 15 of the system, a movable portion coinciding with the fixing element 21 that can be connected to the door leaf of the item of furniture, and at least one first arm 41 and a second arm 42 which connect the fixed portion 39 with the movable portion so that it can swing, respectively by way of at least one first pivoting axis 43, 44 and a second pivoting axis 45, 46.

Alternatively, the hinges 38 can be separate elements, fixed to the item of furniture independently with respect to the hinging system 10.

The invention envisages the presence of elastic "initial opening" means so as to ensure that the door leaf of the item of furniture can be opened by pressing on the closed door leaf, with the elastic "initial opening" means giving an initial thrust for the opening of the door leaf.

Conveniently, the elastic "initial opening" means, which are generally designated by the reference numeral 50, are arranged on the fixed body 15 of the lifting system and are functionally connected to the second lever 19, i.e. to the lever connected to the movable part or box of the hinge that can be fixed to the door leaf.

The second lever 19 is the one that, in the closed position, covers a bigger swinging angle, thus enabling the "initial opening" means to operate optimally.

The elastic "initial opening" means comprise a body 51 for accommodating a spring 52 the preloading of which is preferably adjustable, for example by way of eccentric means 53. The spring 52 is functionally connected to the second lever 19, preferably by way of a slider 55 supported so that it can slide by the fixed body 15 of the lifting system 10. The "initial opening" means 50 are adapted to be actuated, by way of the slider 55, by the second lever 19 and in particular by the abutment of a pivot 54 of the second lever 19 against the slider 55 which acts against the spring 52 which, compressed, reacts by producing a backwards thrust on the slider 55 and therefore on the pivot 54 which is integral with the second lever 19.

The thrust imparted by the slider 55 on the pivot 54 makes it possible to provide an opening thrust to the door leaf of the item of furniture.

In order to reduce the force necessary to open the door leaf, the second cam 25 is contoured so that, in the closed position of the door leaf, substantially no force is applied.

The elastic means 24, owing to the toggle configuration of the levers 17, 19, instead always exert a closing force in the closed position of the door leaf.

In any case, the lifting system according to the invention enables the user to exert a thrust on the door leaf and to have an effective reaction of the elastic "initial opening" means that enables an initial movement to open that door leaf, which the user can then follow through to open the door leaf manually, by gripping the door leaf at its lower edge, even though it lacks a handle.

The foregoing is achievable by virtue of the specific configuration of the system according to the invention, which makes it possible to obtain a high "initial opening" force, capable of defeating the above-mentioned closing force deriving from the first elastic means 24.

In practice it has been found that the lifting system according to the present invention makes it possible to combine a lifting system for door leaves that swing about at least one longitudinal axis with a system of the "push" or thrust type, in which opening of the door leaf occurs, in the absence of a handle on that door leaf, by pressing on the door leaf and triggering the elastic initial opening means 50.

The system, thus conceived, is susceptible of numerous modifications and variations, all of which are within the scope of the appended claims.

Moreover, all the details may be substituted by other, technically equivalent elements.

In practice, the materials used, as well as the contingent shapes and dimensions, may be any according to the requirements and to the state of the art.

The disclosures in Italian Patent Application No. 102016000083263 (UA2016A005980) from which this application claims priority are incorporated herein by reference.

The invention claimed is:

1. A lifting system for door leaves of furniture that swing about at least one horizontal axis between a closed position and a raised open position, the lifting system comprising a supporting body which can be connected to a fixed portion of an item of furniture, a system of articulated levers which are connected to said supporting body and to a door leaf of the item of furniture, said system of levers comprising a first lever which has an end connected rotatably to said supporting body by way of a rotation axis and a second lever which has an end that can be connected rotatably to an element for fixing on said door leaf of the item of furniture, said first lever and said second lever being mutually articulated at respective other ends, and elastic actuation means, which are functionally connected to said system of articulated levers in order to generate a rotation torque for said system of levers, and further comprising elastic initial opening means which are adapted to act functionally on said second lever of said system of articulated levers.

2. The lifting system according to claim 1, wherein said elastic initial opening means comprise a body for accommodating a spring, said spring being adapted to act on a slider that can move with respect to said supporting body.

3. The lifting system according to claim 2, wherein a preloading of said spring is adjustable by way of eccentric means.

4. The lifting system according to claim 1, further comprising cam means, which are provided on at least one of said levers of the system of articulated levers.

5. The lifting system according to claim 4, wherein said cam means comprise cam means that are integral with said second lever, said cam means integral with said second lever being contoured so that, in the closed position, substantially no force is applied on the door leaf.

6. The lifting system according to claim 1, wherein said elastic actuation means are adapted to always apply a closing force in the closed position of the door leaf of the item of furniture.

* * * * *